United States Patent [19]

Single

[11] Patent Number: 4,767,051

[45] Date of Patent: Aug. 30, 1988

[54] KNOCKDOWN CARTON WITH PRE-GLUED BOTTOM

[75] Inventor: Michael R. Single, Stockton, Calif.

[73] Assignee: Willamette Industries, Inc., San Leandro, Calif.

[21] Appl. No.: 883,473

[22] Filed: Jul. 14, 1986

Related U.S. Application Data

[63] Continuation of Ser. No. 708,329, Mar. 5, 1985, abandoned.

[51] Int. Cl.[4] ..... B65D 5/36

[52] U.S. Cl. ..... 229/41 R; 229/41 B; 229/117; 229/184

[58] Field of Search ..... 229/41 R, 41 B, 117, 229/184, 185, 41 C, 41 D, 44 R

[56] References Cited

U.S. PATENT DOCUMENTS

| | | | |
|---|---|---|---|
| 2,332,250 | 10/1943 | O'Reilly | 229/37 R |
| 2,785,844 | 3/1957 | Metzger | 229/117 |
| 3,455,498 | 7/1969 | Gadiel | 229/117 |
| 3,690,543 | 9/1972 | Zeitter | 229/41 B |
| 4,142,666 | 3/1979 | Rosenbaum | 229/41 B |
| 4,266,716 | 5/1981 | Austin | 229/39 R |
| 4,345,711 | 8/1982 | Fischer | 229/41 R |
| 4,378,880 | 4/1983 | Summers | 229/41 B |
| 4,403,729 | 9/1983 | Wytko | 229/44 R |

FOREIGN PATENT DOCUMENTS

| | | | |
|---|---|---|---|
| 1141078 | 1/1969 | United Kingdom | 229/41 B |
| 1454745 | 11/1976 | United Kingdom | 229/44 R |

OTHER PUBLICATIONS

Distribution Packaging by Friedman and Kipnees, 1977, p. 373.

*Primary Examiner*—Stephen Marcus
*Assistant Examiner*—Gary E. Elkins
*Attorney, Agent, or Firm*—Flehr, Hohbach, Test, Albritton & Herbert

[57] ABSTRACT

A box blank for a produce box has four side panels which are hinged together along score lines. An extension flap adjacent one of the side panels is wrapped around and glued to the panel at the opposite end of the blank. The side two major and two minor panels each have an appropriate length flap attached to one edge which is unscored and is to be folded into the top, and a flap on the other edge which is appropriately scored for folding to form the bottom of the box. More specifically, two minor and two major panels are attached to edges of the side panels, at a scored hinge line. Each minor panel has a triangle scored thereon, the base of the triangle being the hinge line with the side flap. One end of each major panel is attached to a minor panel; the other end of each major panel has a score line, roughly defining a triangle which will overlap ½ of the triangle scored onto the minor flap. In assembling the bottom of the box, the major flaps are first bent in toward the bottom and then the triangular corner flap on each major flap is bent outward to lie against the outside surface of the major flap. The free triangular corner of the minor flap, which is preferably truncated for each easy folding, is now folded underneath, and then the minor flap is folded down against the bottom surface being formed. Glue can now be applied in a single straight stroke across the exposed half of the triangle scored on the minor flap.

4 Claims, 4 Drawing Sheets

KNOCKDOWN CARTON WITH PRE-GLUED BOTTOM

Figure 1:
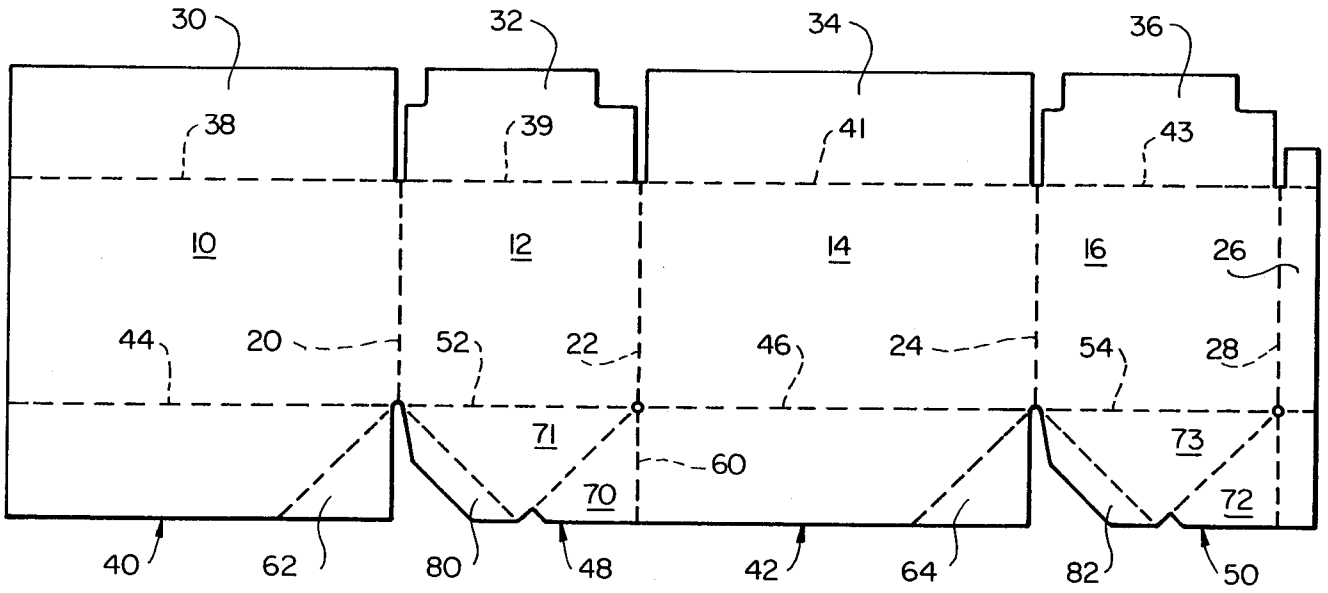

This is a continuation of application Ser. No. 708,329 filed March 5, 1985 now abandoned.

This invention is directed generally to the field of boxes, and more particularly to pre-glued boxes.

The box industry operates on a high volume basis where ease of manufacture and assembly account for greater economic advantage. This is especially true in the field of boxes used for shipping vegetables and the like. Many vegetables, such as celery, lettuce and other crops are quite heavy when packed in boxes for volume shipping, and some contain a significant amount of water. Therefore, in some cases the boxes must be waxed in order to prevent the water from damaging the fibreboard; for lettuce and others the boxes do not have to be waxed. Moreover, the boxes should be glued, stapled or otherwise fastened together; press fits, interlock, or other approaches to box assembly cannot provide enough security against a box coming apart during shipment.

It is therefore an objective of the present invention to provide a new and improved pre-glued box, ready to pack in the field.

In some areas of the fruit and vegetable field pack business, growers have concluded that the only reasonable approach to the use of boxes having fastened bottoms is to have the boxes assembled or the flaps joined in the field. This necessitates hiring a trained crew which must use special, very expensive equipment to assemble the boxes on the site of the packing.

It is a further objective of the present invention to simplify the operation of the equipment needed to assemble the box or carton.

More particularly, it is an objective of the present invention to provide a box with a reduced number of glue joints assembling the box, while providing a stronger bottom for the box.

Further, it is an objective of the present invention to provide a box which has a glue joint wherein the glue is easy to apply in a single stroke across the joint to simplify any operation of the assembly equipment. A related objective of the present invention is to provide a box having a glue joint put together in a way that increases the strength of the glue joint.

It is frequently difficult to ship set-up, pre-glued bottom boxes into the field as they occupy a great deal of space. Therefore, it is an objective of the present invention to provide a design of a box blank which, after assembly into a set-up carton is easily flattened for volume shipment into the field.

It is an objective of the present invention to provide a box blank and method of assembly of such a blank into a pre-glued, prescribed, carton which is easier to assemble than those previously designed.

More particularly, it is an objective of the present invention to provide a pre-glued, knockdown box which can be economically assembled by a machine and operated by relatively semi-trained labor.

It is an objective of the present invention to provide a knockdown box which can be set up in the field with a minimum effort.

More particularly, it can be set up easily by pushing on opposite ends of the box; no exact finger placement is necessary. No extra score lines in the side panels of the box are necessary.

These and other objectives of the present invention are provided by utilizing a box blank incorporating four side panels hinged together along score lines. An extension flap is provided adjacent one of the side panels which can be wrapped around and glued to the end panel at the opposite end of the blank. The side panels typically comprise two major and two minor panels; each of the panels has an approprite flap attached to one edge which is unscored and is to be folded into the top, and a flap on the other edge which is appropriately scored for folding to form the bottom of the box. More specifically, two minor and two major flaps are attached to edges of the side panels, at a scored hinge line. Each minor flap has a triangle scored thereon, the base of the triangle being the hinge line with the side flap. One end of each major flap is attached to a minor flap; the other end of each major flap has a score line, roughly defining a triangle which will overlap one-half of the triangle scored onto the minor flap.

In assembling the bottom of the box, the major flaps are bent in toward the bottom in an alternating sequence; after the first major flap in folded down, one minor flap is folded in toward the bottom of the box, then the other major flap is folded down. The triangular corner flap on each major flap is then bent outward to lie against the outside surface of the major flap. The free triangular corner of the minor flap, which is preferably truncated for easy folding, is now folded underneath, and the remaining minor flap is folded down against the bottom surface being formed. Glue can now be applied in a single straight stroke across the exposed half of the triangle scored on the minor flap and the exposed surface of the triangular corner of the major flaps. When the triangular corner flaps are now folded forward, the straight glue lines which lie on this triangular corner flap will lie at a 90° angle across the glue lines on the exposed portion of the minor flap, thus providing a very strong adhesive bond between this triangular corner flap and the minor flap. The box ca now easily be flattened simply by pushing up on one of the major flaps and apply pressure to a side panel.

Figure 2A:
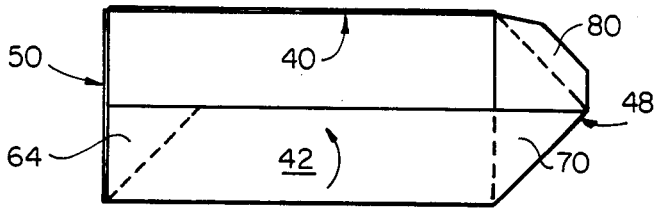
Figure 3:
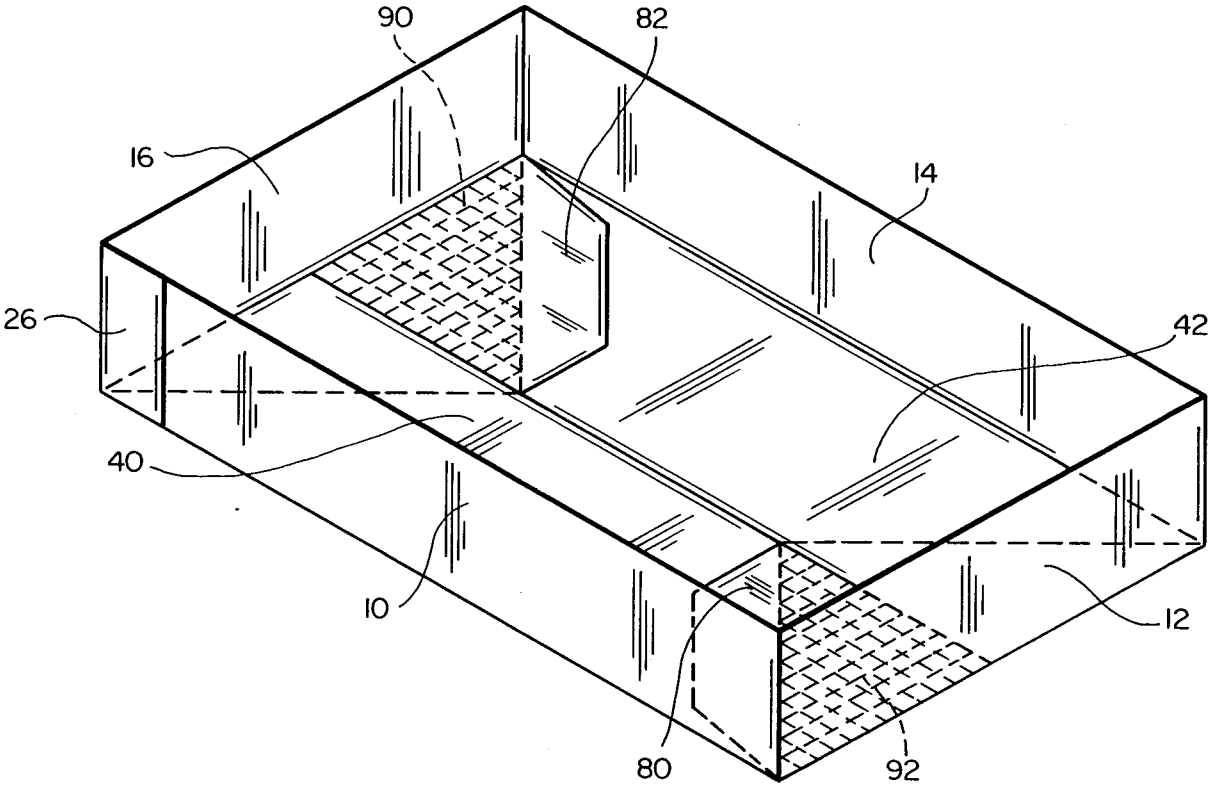

Other features and advantages of the present invention will become apparent to a person of skill in this art who studies the following invention disclosure with reference to the accompanying figures:

FIG. 1 is a plan view of the box blank used to form the carton of the present invention;

FIGS. 2A, B, C, D, E, F, G, and H show successive stages of assembly of the bottom of the box of the present invention; and FIG. 3 is a perspective view of the box formed by the present invention without any of the top flaps being illustrated.

In the drawing illustrations and descriptions which follow, the box is described as being constructed of a semi-rigid material such as a pre-waxed corrugated or dry corrugated fibreboard. However, it should be understood that the knockdown box of this invention may be fabricated of many other suitable materials. That is, the blank is also useful in forming dry, unwaxed boxes. Further, the carton and the blank from which it is formed are described with reference to major and minor flaps which are scored specifically to be folded inot the bottom ofthe box. However, it should be understood that the described portions of the flaps may be moved from one flap (described here as a major or minor flap) to a flap of slightly greater or lesser extent without avoiding the use of the novel claimed features of the present invention.

The rectangular box such as is shown in the perspective view in FIG. 3 is formed by a generally rectangular blank which has been suitably cut, scored and perforated, as shown in the plan view of FIG. 1. In its completed form, the box has gusseted corners, i.e., the corners are effectively hooked together and interlocked to prevent unfolding of the box. In a key feature of the present invention, glue need only be applied to two corners of the bottom flaps of the partially folded blank in forming the blank into the box of the present invention.

Moreover, glue can be applied in a single stroke to what will eventually be overlapping portions of separate flaps, resulting in a very strong bond when the flaps are overlapped, as the glue lines on one flap will then be turned 90° with respect to the glue lines on another flap. Further, although the box corners are tightly sealed to prevent the unintended collapse of the box when it is fully loaded, the empty box may be easily collapsed and flattened for easy shipment.

The box appears in FIG. 3 in a perspective view with some of the flaps shown in dotted lines for aid in understanding the relative locations of the major and minor flaps in the finished folded box of the present invention.

Referring to FIG. 1, the box blank of the present invention includes four consecutive ends and side panels 10, 12, 14, 16 hinged together at hinge joints 20, 22, 24. An extension flap 26 is hinged to one of the side panels at a hinged score line 28.

As noted above, at the start of the process of forming the box, the extension panel 26 is glued to the side panel 10 at the opposite end of the box, so that the panel 10 is effectively hinged to the end panel 16 by the hinge line 28 at the opposite end of the box.

The side panels 10–16 each have a set of top flaps 30, 32, 34, 36 hinged to the side and end panels at edge score lines 38, 39, 41, 43. These top flaps are folded down to close the top of the box in accordance with standard practice. They do not form any novel part of the invention and will not be discussed further in this disclosure.

The other edge of the major side panels includes major flaps 40, 42 joined to the side panels at hinge lines 44, 46. Also minor flaps 48, 50 are provided hinged to side panels 52, 54.

It should be noted that the major flap 42 and minor flap 48 are effectively joined together at a scored hinge line 60; further, the minor flap 50 is joined to the major flap 40 about hinge line 28, after the extension flap 26 is glued to the opposite end of the panel. This is to facilitate folding the flaps to form the bottom of the box using automated equipment rather than accomplishing the folding by hand. That is, folding in the major flaps 40, 42 will, as shown below, cause certain folds to occur in the minor flaps 48, 50. Each of the major flaps also includes a triangular corner flap 62, 64 at the opposite end of the major flap from the associated minor flap.

Figure 2B:
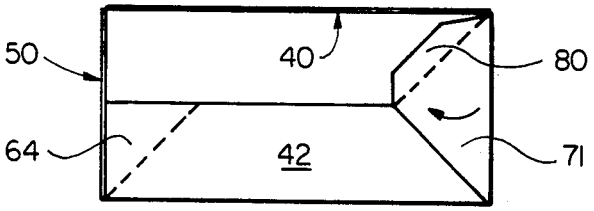

In assembling the box, as a first step (FIG. 2A) one of the two major flaps 42 is folded in toward the bottom of the box. Folding in the major flap 42 also causes the isosceles triangle 70 on the hinged side of the minor flap 48 to fold flat against a part 71 of the remainder of the associated minor flap 48. The minor flap 48 is now folded down (FIG. 2B) against the bottom along score line 52. The other major flap 40 is now folded down (FIG. 2C); the corner triangle 72 lies flat on part 73 of the minor panel 50.

The triangular corner portions 62, 64 of major flaps 40, 42 can now be folded back out (FIG. 2D) away from the direction of folding the bottom flaps 40, 42 until these corners 62, 64 lie flat against the ouside surface of major flaps 40, 42.

Figure 2C:
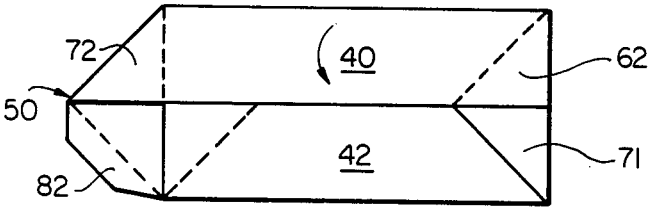
Figure 2D:
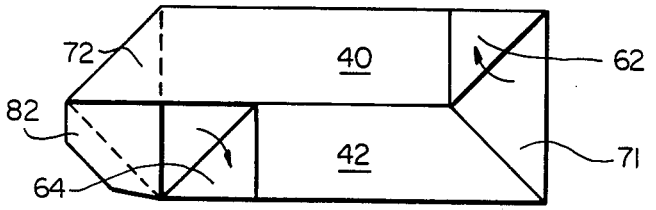
Figure 2E:
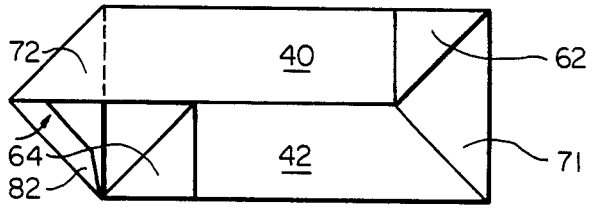
Figure 2F:
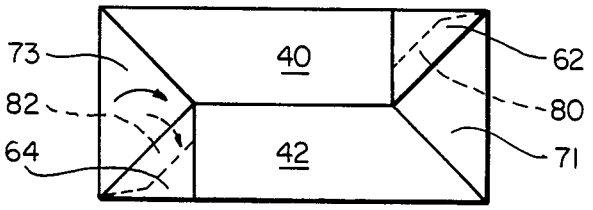

The flap 82 (See FIG. 2E) which is the remainder of the opposite, truncated corner of minor flap 50 is then folded underneath, i.e., toward the direction of the assembly of the bottom of the box. The minor flap 50 which is now triangular in shape, is then folded in (Fig. 2F) toward the bottom of the box, flat against major flap 40 (FIG. 2C). A rectangular bottom shape now appears, with triangular corners 62, 64 still folded out against major flaps 40, 42.

Figure 2G:
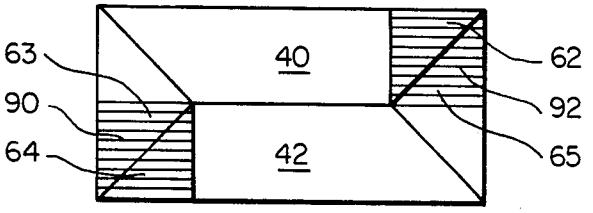
Figure 2H:
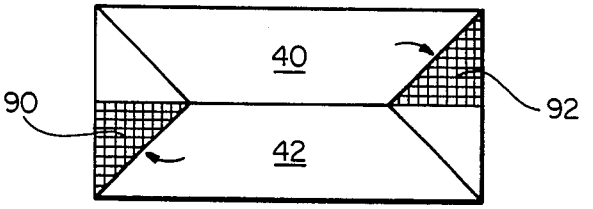

Stripes of glue 90, 92 are now striped on in a single motion across the inner triangular portion of each of the minor flaps and the backfolded corner flap 62, 64 of each major flap 40, 42 (see FIG. 2G). The flaps 62, 64 are now rotated back (as shown in FIG. 2H) against and overlying these inner triangular corner flaps. The two pairs of flaps 64, 65 and 62, 63 are of approximately the same size; the glue lines on each member of the pair are rotated 90°. The grid which is formed by the rotation of the flaps 63, 65 over the inner triangular corners 63, 65 forms an extremely tight bond with the result that the entire bottom section is now glued together in a single piece, providing a gusseted reinforced corner which cannot collapse outwardly even under significant weight.

The boxes described above can be assembled at a remote location and easily collapsed simply by pushing inward from the bottom of the box on the major flaps while pushing inward on the box bottom.

Modification of the present invention may become apparent to a person of skill in the art who studies the above invention disclosure. For example, the sequence shown in FIGS. 2B and 2C can be changed to fold in both major flaps, fold a truncated corner on each minor flap to then fold in the minor flaps. Therefore, the scope of the present invention is to be limited only by the following claims.

What is claimed:

1. A box formed from a single blank of foldable material and comprising four side wall panels, each connected along at least one scored edge to an adjacent one of the side wall panels;

four bottom forming flaps hingedly connected to the side wall panels, the bottom forming flaps comprising two major and two minor flaps, each of said major flaps being rectangular in shape and integrally connected along an edge score line with one of said minor flaps; each of said minor flaps includes a pair of score lines defining an isosceles triangle whose base line is the score line which hingedly connects the minor flap to the side wall panel, the peak of the triangle being at the edge of the minor flap distant from said edge score line, the triangle thereby defining fold lines for each corner of the minor flap, each of said major flaps having a triangular corner flap defined by a score line drawn angularly across a corner of said major flap, each said triangular corner flap being fastened to an inner triangular portion of one of said minor flaps, and an overlapping grid pattern of glue lying between each said triangular corner flap of said major flap and said inner triangular portion of said minor flap, fastening said triangular corner and said inner triangular portion whereby a box having a bottom with gussetted corners is formed.

2. A box as claimed in claim 1, each said minor flap having a notched edge adjacent the peak corner of said triangle to allow the triangular corner portion to fold past the other flaps of the box.

3. A blank for a box movable from a flattened knock-down position to an erected use position, said blank comprising four side wall panels, three of said panels being connected along at least one scored edge to a next adjacent one of the side wall panels, the fourth being connected along a scored edge to an extension flap adapted to be glued to the farthest one of the three side wall panels;

four bottom forming flaps hingedly connected to the side wall panels, the bottom forming flaps comprising two major and two minor flaps, each of said major flaps being integrally connected along an edge score line with one of said minor flaps, each of said major flaps having a triangular corner flap defined by a score line drawn angularly across said flap, said triangular flap being adapted to overlie and be fastened to an inner triangular portion of one of said minor flaps, each of said minor flaps is connected at a score line forming a hinge to an overlap portion extending along the minor flap and the associated major flap, each of said minor flaps includes a score line defining an isosceles triangle whose base line is the score line which hingedly connects the minor flap to the side wall panel, the peak of the triangle being at the edge of the minor flap distant from the edge score line, the triangle thereby defining fold lines across each corner of the minor flap which is not defined by said base line.

4. A blank as in claim 3 wherein one of said outer corners of each of said minor flaps is truncated, said truncated outer corner of at least one of said minor flaps being defined by one of said score lines on the minor flap and hinged at the score line toward a folded position in forming the carton from said blank.

* * * * *